US006199302B1

(12) United States Patent
Kayano

(10) Patent No.: US 6,199,302 B1
(45) Date of Patent: Mar. 13, 2001

(54) ATHLETIC SHOE

(75) Inventor: Toshikazu Kayano, Kobe (JP)

(73) Assignee: Asics Corporation (JP)

( * ) Notice: Subject to any disclaimer, the term of this patent is extended or adjusted under 35 U.S.C. 154(b) by 0 days.

(21) Appl. No.: 09/378,604

(22) Filed: Aug. 20, 1999

(30) Foreign Application Priority Data

Sep. 8, 1998 (JP) ..... 10-272542

(51) Int. Cl.[7] ..... A43B 13/18

(52) U.S. Cl. ..... 36/28; 36/30 R; 36/35 R; 36/144

(58) Field of Search ..... 36/25 R, 28, 30 R, 36/31, 35 R, 144

(56) References Cited

U.S. PATENT DOCUMENTS 2,048,683 * 7/1936 Broockman .
4,813,160 * 3/1989 Kuznetz .
4,912,858 * 4/1990 Mochizuki .
5,131,173 * 7/1992 Anderie .
5,195,256 * 3/1993 Kim .
5,224,277 * 7/1993 Sang Do .
5,367,792 * 11/1994 Richard et al. .
5,575,089 * 11/1996 Giese et al. .
5,787,610 * 8/1998 Brooks .
6,014,821 * 1/2000 Yaw .

FOREIGN PATENT DOCUMENTS 59-11610 4/1984 (JP) .
61-7801 3/1986 (JP) .
62-200904 12/1987 (JP) .
3-51005 5/1991 (JP) .

* cited by examiner

*Primary Examiner*—Ted Kavanaugh
(74) *Attorney, Agent, or Firm*—Michael Zall

(57) ABSTRACT

An athletic shoe comprises an upper (3) for accommodating an instep of a foot, and outer sole (4) having a tread on bottom surface, and a midsole (1) interposed between the upper (3) and the outer sole (4). A shock absorbing groove (2) is formed in the midsole (1). The shock absorbing groove (2) is formed of a long transverse groove (20) and a short longitudinal groove (21) in a continuous manner. The transverse groove (20) is formed on the midsole (1) extending from a side face of a rear foot part (1B) of the midsole (1) on lateral side (10) of the foot to a back face of a heel part (1H) of the midsole (1) and has an end (22) on the heel part (1H). The longitudinal groove (21) is formed in such a manner as to cut out the heel part (1H) of the midsole (1) from a lower end face of the midsole (1) toward the end of the transverse groove (20).

5 Claims, 12 Drawing Sheets

ATHLETIC SHOE

BACKGROUND OF THE INVENTION

1. Field of the Invention

The present invention relates to an athletic shoe used at the time of going out, jogging and playing sports in daily life.

2. Description of Prior Arts

Midsole is a member arranged on an outer sole and absorbs a shock at the time of landing one's foot. For that purpose, the midsole is composed of a material effective in shock absorption and resilience such as EVA (ethylene-vinyl acetate copolymer) sponge (foam). To achieve the characteristics of EVA, hardness of the EVA sponge is usually set to a relatively small value of 40° to 60°. As a result, increase of pronation is accelerated in some cases.

Generally, during running, a foot landed from lateral side (outside) of a heel becomes parallel to a road surface and subsequently the heel of the foot inclines a little toward medial side (inside). This inclination of heel toward medial side is called "pronation". When hardness of the EVA sponge is small as mentioned above, the pronation is accelerated. An excessive movement of pronation or a movement of pronation for a long time is called an over-pronation, and generally this over-pronation is not desirable.

A sole for restraining the pronation was developed. FIG. 17 is a plan view showing a midsole disclosed in the Japanese Patent Publication (examined) No. 61-7801. FIG. 18 is a side view showing the midsole disclosed in the same patent publication.

As shown in these drawings, in the prior art disclosed in the mentioned patent publication, a pronation restraining member 202 of a larger hardness than that of a midsole body 201 is disposed at a medial side 11 of a rear foot part of a midsole 200. The midsole 200 according to this prior art supports the medial side of the heel of the foot by the pronation restraining member 202 of a larger hardness, and prevents the heel from inclining toward the medial side of the foot.

However, in this prior art, there exists a problem of easily occurring a feeling of unfitness in the foot when hardness of the pronation restraining member 202 is excessively large.

FIG. 19 is a side view showing a shoe disclosed in the Japanese Laid-Open Utility Model Publication (unexamined) No. 3-51005. FIG. 20 is a bottom view of the sole disclosed in the same publication.

As shown in these drawings, in this prior art disclosed in the above publication, a groove 302 is formed substantially all over outer periphery of a rear foot part 301 of the sole 300 and extending almost equally to left and right (almost equally to medial and lateral sides). This groove 302 improves cushioning performance of the rear foot part of the sole 300.

Several other prior arts for improving the cushioning performance of sole by providing a groove extending equally to medial and lateral sides are also disclosed in the Japanese Utility Model Publication (examined) No. 59-11610 and in the Japanese Laid-Open Utility Model Publication (unexamined) No. 62-200904. These prior arts, however, cannot restrain the pronation.

SUMMARY OF THE INVENTION

The present invention was made to solve the above-discussed problems incidental to the prior arts and has an object of providing an athletic shoe for restraining pronation.

Another object of the invention is to provide an athletic shoe for restraining supination.

An athletic shoe for restraining pronation according to the invention comprises an upper for accommodating an instep of a foot, and outer sole having a tread on bottom surface, and a midsole interposed between the upper and the outer sole. A shock absorbing groove is formed in the midsole. The shock absorbing groove is formed of a long transverse groove and a short longitudinal groove in a continuous manner. The transverse groove is formed on the midsole extending from a side face of a rear foot part of the midsole on lateral side of foot to a back face of a heel part of the midsole, and has an end on the heel part. The longitudinal groove is formed in such a manner as to cut out the heel part of the midsole from a lower end face of the midsole toward the end of the transverse groove.

In the invention, the expression "the transverse groove has an end on the heel part" means that the long transverse groove is formed on one side of the rear part of the midsole, and not formed on another side.

The "shock absorbing groove" in the invention exhibits not only a function of shock absorption but also a function of restraining the pronation, as described below.

When running putting on the athletic shoe for restraining the pronation according to the invention, the portion of lateral side of foot in the midsole is compressed vertically at the portion of the long transverse groove and deformed at the time of landing, and the foot tends to incline toward the lateral side. As a result, the pronation of inclining the foot toward the medial side can be restrained.

Further, in the invention, as the short longitudinal groove is provided in such a manner as to rise toward the end of the transverse groove, the influence of the deformation occurred at the portion of the transverse groove is shut out at the portion of the longitudinal groove. Therefore, even when the portion of lateral side of the midsole is deformed at the time of landing the foot, the portion of medial side is hardly deformed. As a result, the pronation can be sufficiently restrained.

An athletic shoe for restraining supination according to the invention comprises an upper for accommodating an instep of a foot, and outer sole having a tread on bottom surface, and a midsole interposed between the upper and the outer sole. A shock absorbing groove is formed in the midsole. The shock absorbing groove is formed of a long transverse groove and a short longitudinal groove in a continuous manner. The transverse groove is formed on the midsole extending from a side face of a rear foot part of the midsole on medial side of foot to a back face of a heel part of the midsole, and has an end on the heel part. The longitudinal groove is formed in such a manner as to cut out the heel part of the midsole from a lower end face of the midsole toward the end of the transverse groove.

The "shock absorbing groove" in the invention exhibits not only a function of shock absorption but also a function of restraining the supination, as described below.

When running putting on the athletic shoe for restraining the pronation according to the invention, the portion of medial side of foot in the midsole is compressed vertically at the portion of the long transverse groove and deformed at the time of landing, and the foot tends to incline toward medial side. As a result, the supination of inclining the foot toward the lateral side can be restrained.

Further, in the invention, as the short longitudinal groove is provided in such a manner as to rise toward the end of the transverse groove, the influence of the deformation occurred at the portion of the transverse groove is shut out at the portion of the longitudinal groove. Therefore, even when the portion of medial side of the midsole is deformed at the time of landing the foot, the portion of lateral side is hardly deformed. As a result, the supination can be sufficiently restrained.

BRIEF DESCRIPTION OF THE DRAWINGS

The invention will be understood more obviously from the following description of the preferred embodiment with reference to the accompanying drawings. It is to be noted that the embodiment and the drawings are just for illustration and description and should not be used to define the scope of the invention. The scope of the invention is defined by the appended claims. In the drawings, same reference numerals are designated to same or like parts.

DESCRIPTION OF THE PREFERRED EMBODIMNET

Embodiments of the present invention are hereinafter described with reference to the drawings.

First Embodiment

FIGS. 1 to 8 show a first embodiment.

This embodiment is an athletic shoe for restraining pronation.

Figure 1:
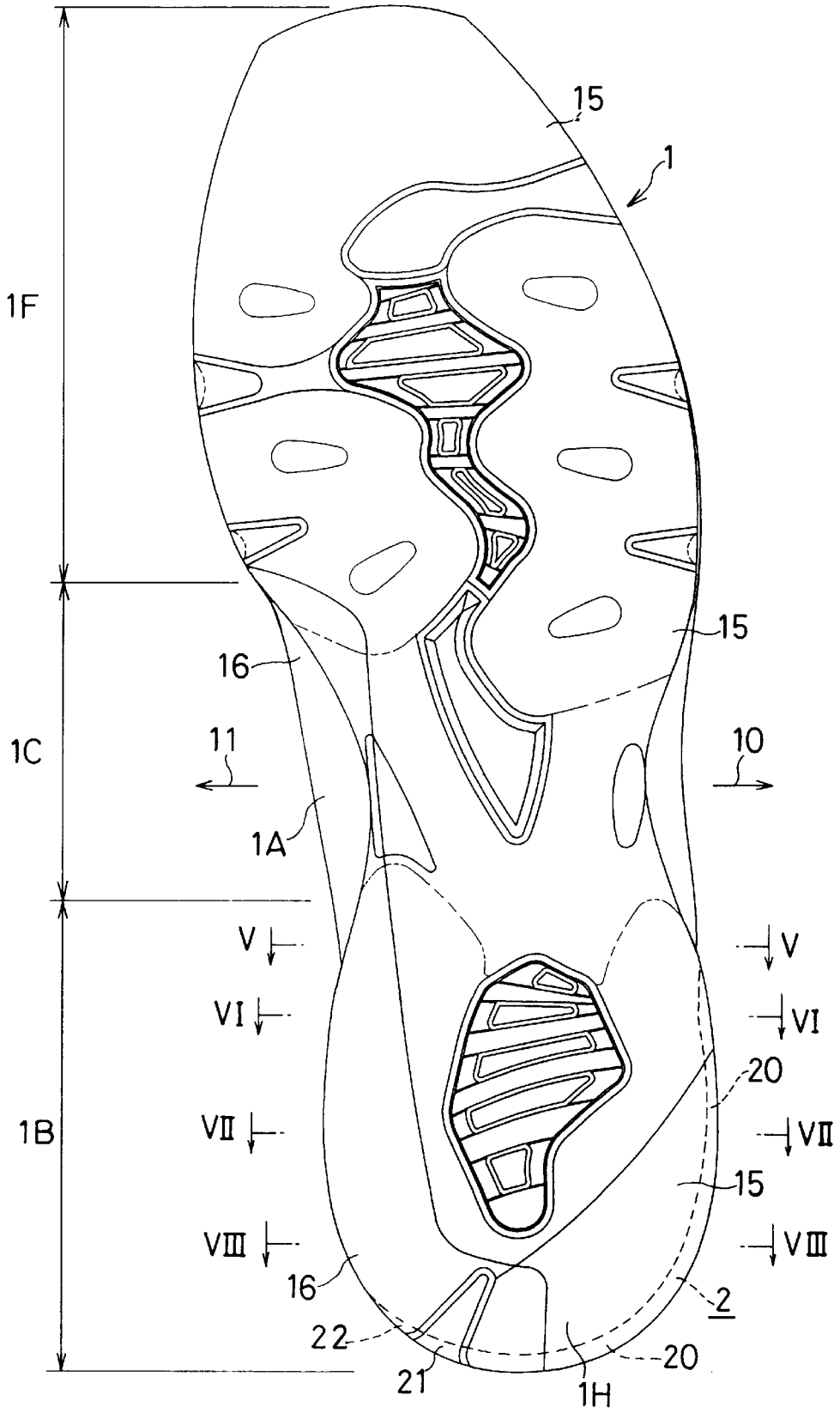
FIG. 1 is a bottom view of a midsole according to a first embodiment of the present invention.
Figure 2:
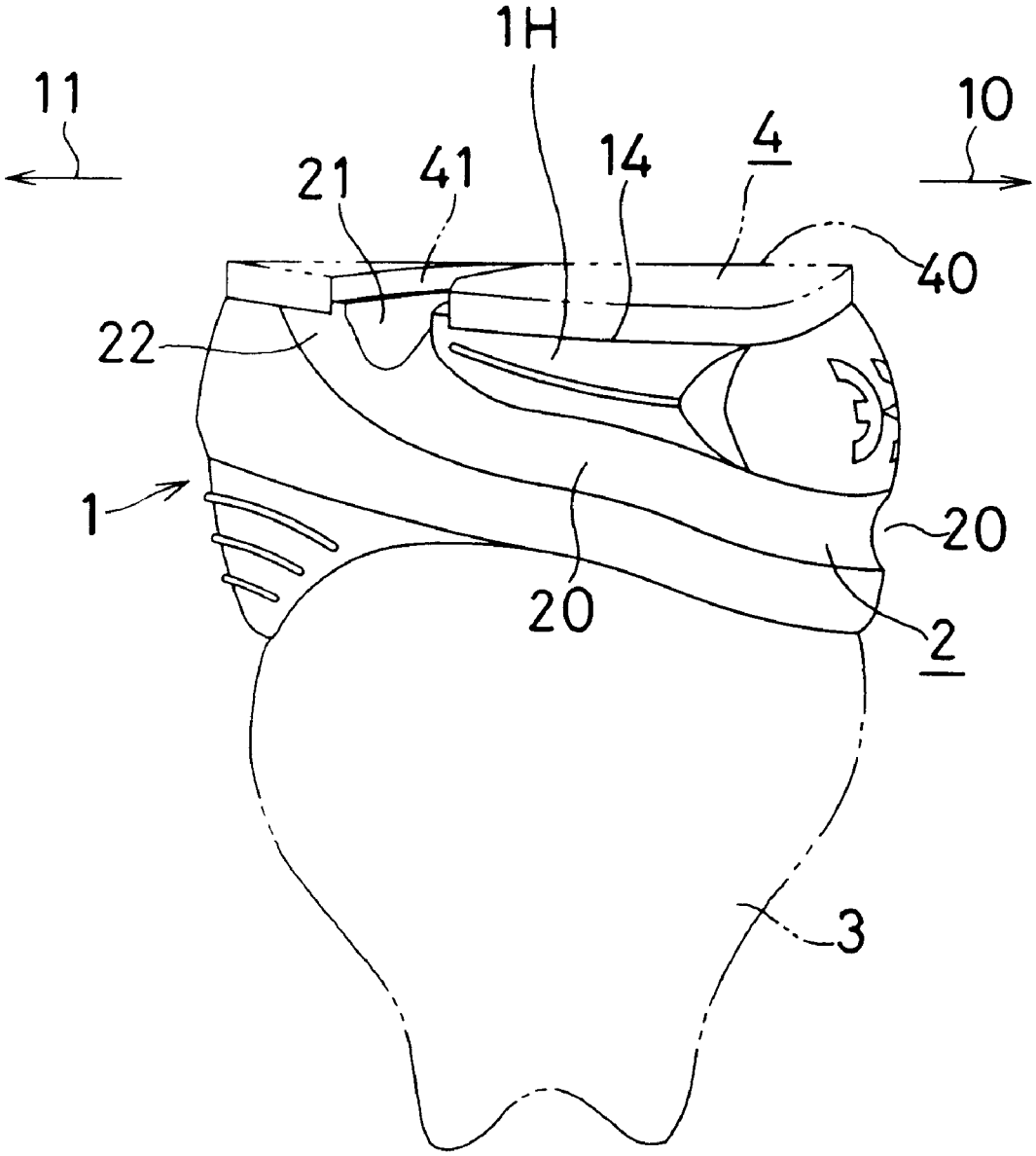
FIG. 2 is a rear view of a midsole according to the first embodiment of the invention.
Figure 3:
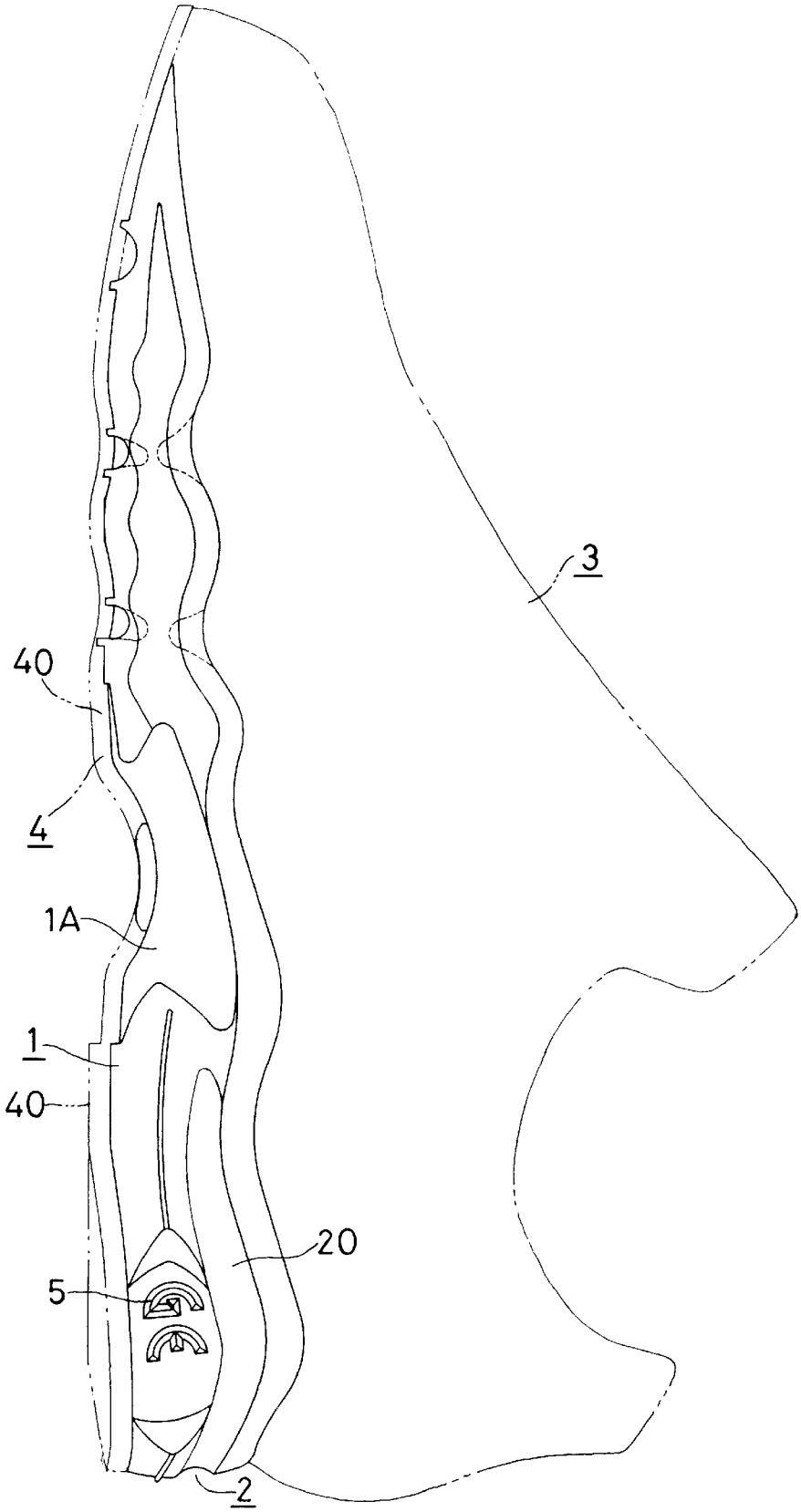
FIG. 3 is a side view of a midsole taken from the lateral side of a foot according to the first embodiment of the invention.

As shown in FIGS. 2 and 3, a midsole 1 is interposed between an upper 3 and an outer sole 4, and forms a part of the athletic shoe. The upper 3 adapted to accommodate the wearer's foot so as to cover the instep of the foot. On the other hand, the outer sole 4 has a tread 40 on its outer surface, and has an exterior tread surface adapted to touch a surface such as, for example, a ground surface or a floor surface. In FIGS. 1 to 4, to make clear respective portions of the midsole 1, the upper 3 and the outer sole 4, the midsole 1 is shown by solid line, while the upper 3 and the outer sole 4 are shown by two-dot chain line.

The midsole 1 shown in FIG. 1 absorbs a shock applied to the foot at the time of landing, or produces repulsive force at the time of stepping forward. The midsole 1 extending from a forefoot part 1F to a rear foot part 1B, is mainly composed of a resin (such as EVA, polyurethane) foam or a rubber foam, and includes a shock absorbing material such as gel if required.

The outer sole 4 in FIG. 3 grips a road surface or a floor at the time of landing, and an abrasion resistance is required in addition to the gripping characteristic. The outer sole 4 is mainly composed of a foam material or a non-foam material of diene rubber.

Referring to FIG. 1, in the midsole 1, a shock absorbing groove 2 is formed as shown by broken line. The shock absorbing groove 2 comprises a long transverse groove 20 shown in FIGS. 2 and 3, and a short longitudinal groove 21 shown in FIGS. 1 and 2.

The transverse groove 20 is formed on the midsole 1 extending from a side face of the rear foot part 1B of the midsole 1 on a lateral side 10 of a foot to a back face of a heel part 1H of the midsole 1, and has an end 22 on the back face of the heel part 1H. That is, the transverse groove 20 is not formed on a medial side 11 of the foot in the midsole 1.

As shown in FIG. 2, the longitudinal groove 21 is formed in such a manner as to cut out the heel part 1H of the midsole 1 from a lower end face 14 of the midsole 1 toward the end 22 of the transverse groove 20. As shown in FIG. 1, the longitudinal groove 21 is formed in such a manner as to cut out the midsole 1 a little long toward the fore part of the foot. In addition, a cutout portion 41 is also formed on the outer sole 4 shown in FIG. 2 at a location corresponding to the longitudinal groove 21 formed on the midsole 1.

The midsole 1 comprises a midsole body 15 and a pronation control section 16 as shown in FIG. 1. The pronation control section 16 is provided at the medial side 11 of the rear foot part 1B and the medial side 11 of an arch part 1A or a mid foot part 1C on the midsole 1. On the other hand, the midsole body 15 is provided at portions other than the portion where the pronation control section 16 is provided, for example, at the middle and the portion of lateral side 10 of the rear foot part 1B of the midsole 1 and at the forefoot part 1F of the midsole 1. Hardness of the pronation control section 16 is set to a larger value than that of the midsole body 15. For example, hardness of the midsole body 15 is set to about 45° to 60°, while hardness of the pronation control section 16 is set to about 60° to 70°. The hardness herein is a value obtained by measuring with a JIS C type hardness meter.

When running putting on the athletic shoe according to this embodiment, the portion of lateral side 10 of the midsole 1 is deformed in such a manner as to be compressed vertically at the transverse groove 20, and the pronation of inclining the foot toward the medial side 11 can be restrained.

Furthermore, as shown in FIGS. 5 to 8, as the pronation control section 16 of larger hardness is provided on the medial side 11 of the foot, the pronation can be sufficiently restrained.

Figure 4:
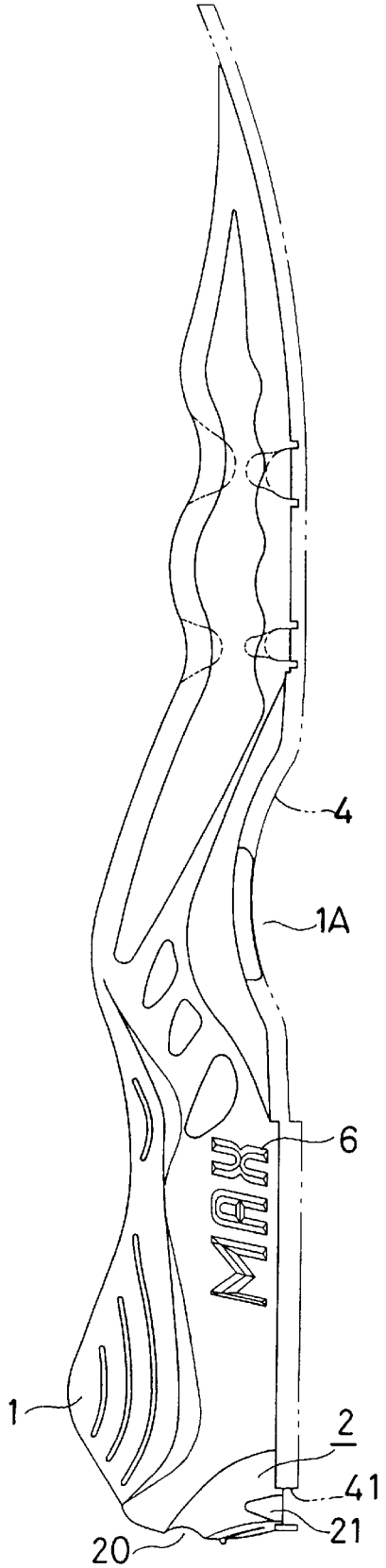
FIG. 4 is a side view of a midsole taken from the medial side of the foot.
Figure 5:
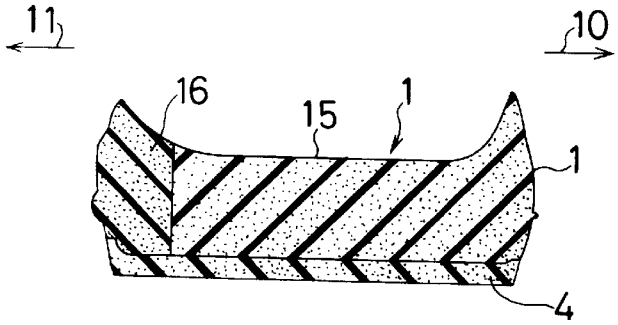
FIG. 5 is a sectional view taken along the line V—V in FIG. 1.
Figure 6:
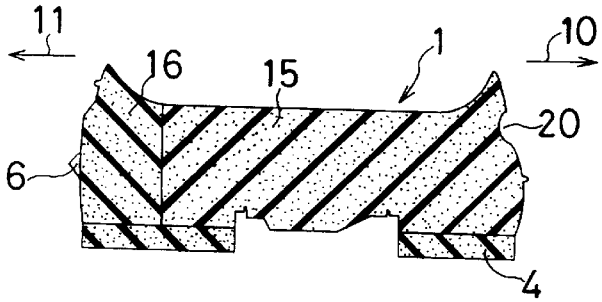
FIG. 6 is a sectional view taken along the line VI—VI in FIG. 1.
Figure 7:
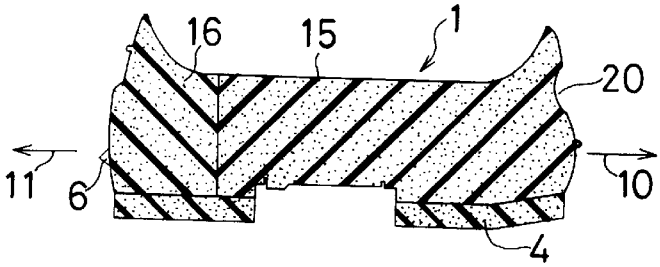
FIG. 7 is a sectional view taken along the line VII—VII in FIG. 1.
Figure 8:
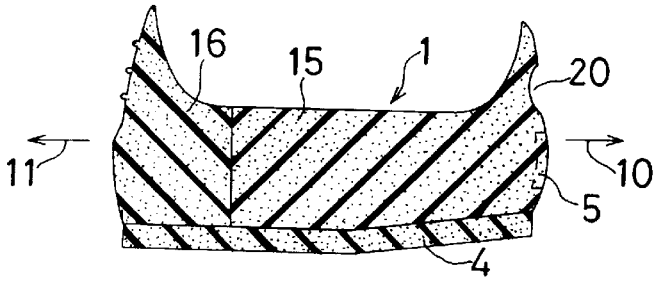
FIG. 8 is a sectional view taken along the line VIII—VIII in FIG. 1.

In this respect, considering the compressive deformation of the midsole 1, it is preferable that letters 5 on the side face on which the transverse groove 20 is provided in FIG. 3 are formed by concave groove. It is preferable that letters 6 on the side face on which the transverse groove 20 is not provided in FIG. 4 are formed by convex line.

Second Embodiment

FIGS. 9 to 16 show a second embodiment.

This embodiment is an athletic shoe for restraining supination.

Figure 10:
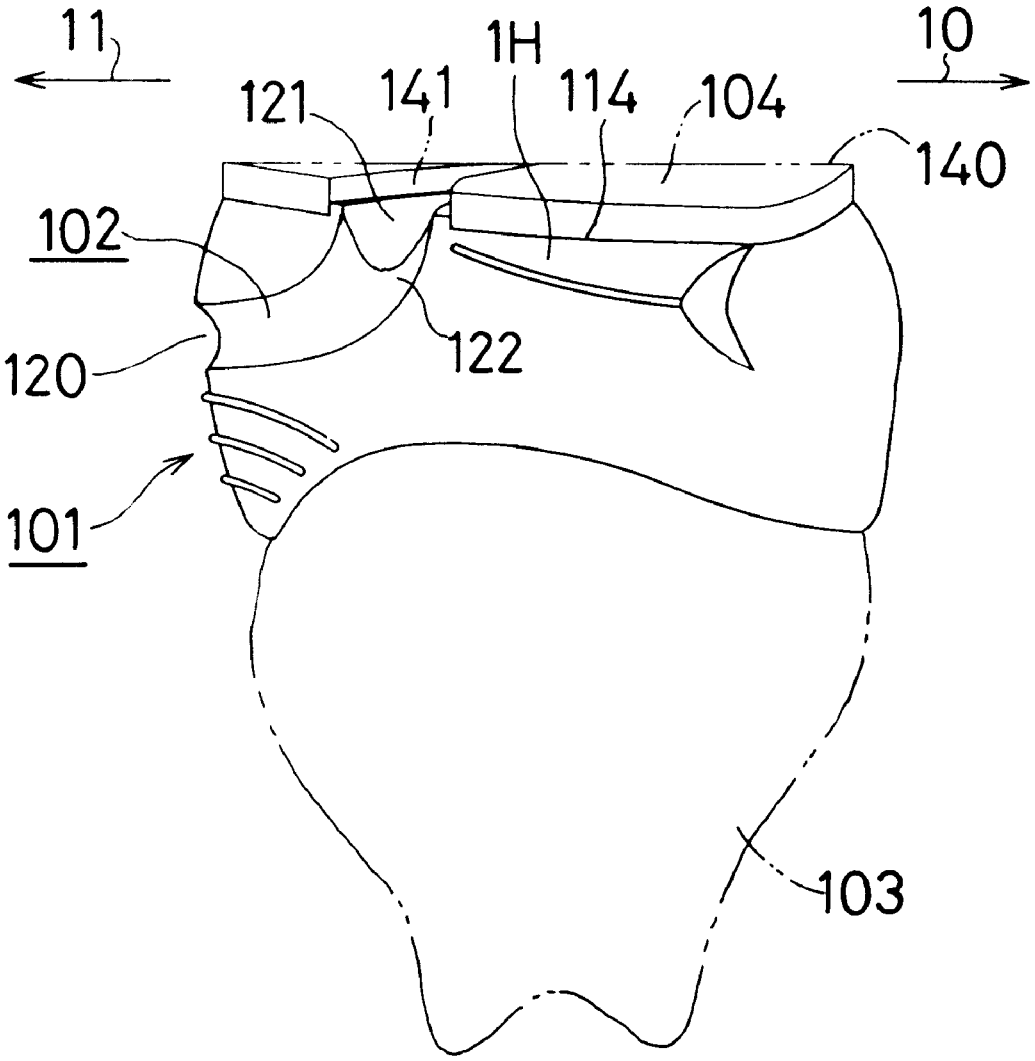
FIG. 10 is a rear view of amidsole according to the second embodiment of the invention.
Figure 11:
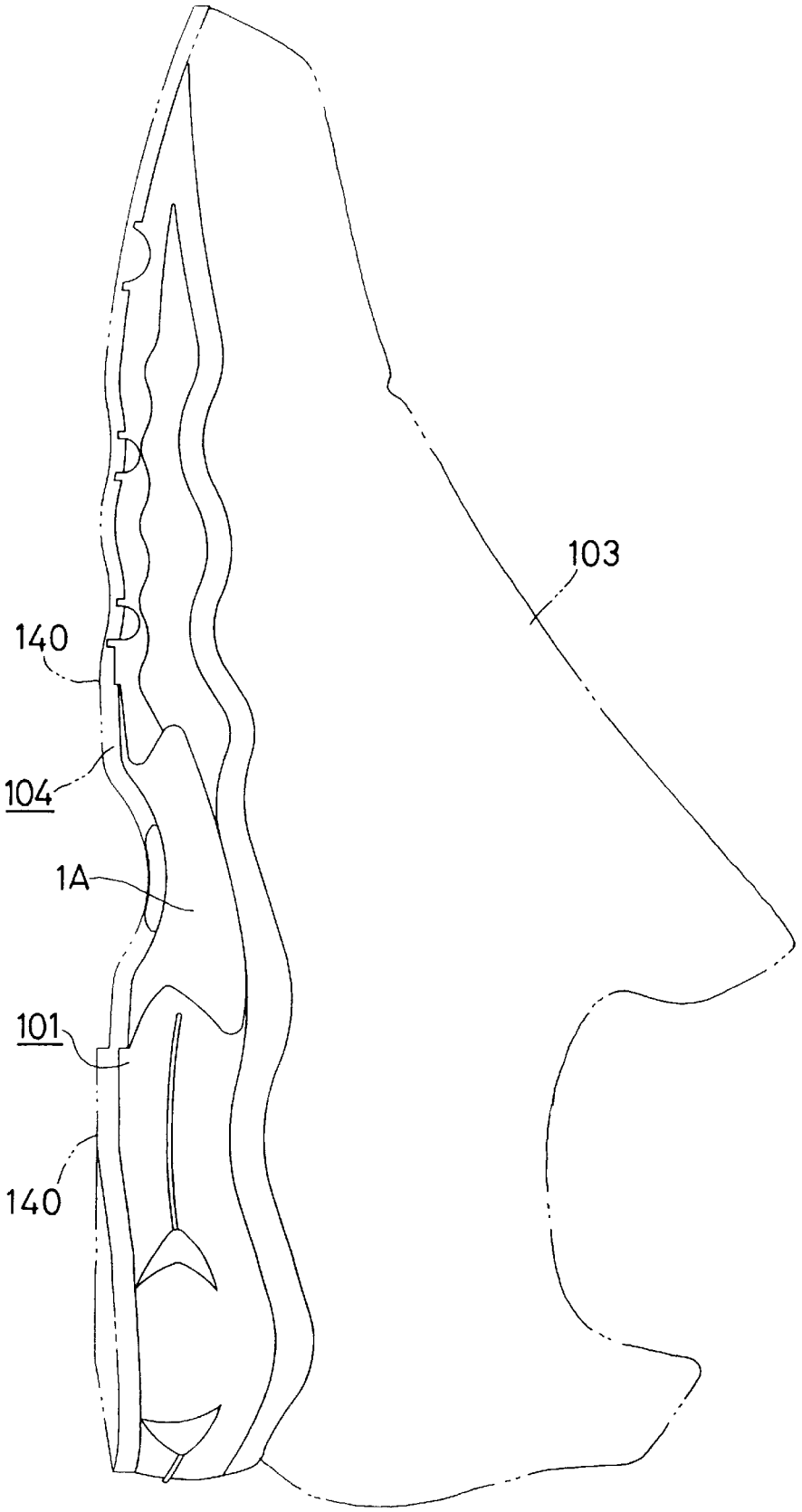
FIG. 11 is a side view of a midsole taken from the lateral side of a foot according to the second embodiment of the invention.
Figure 12:
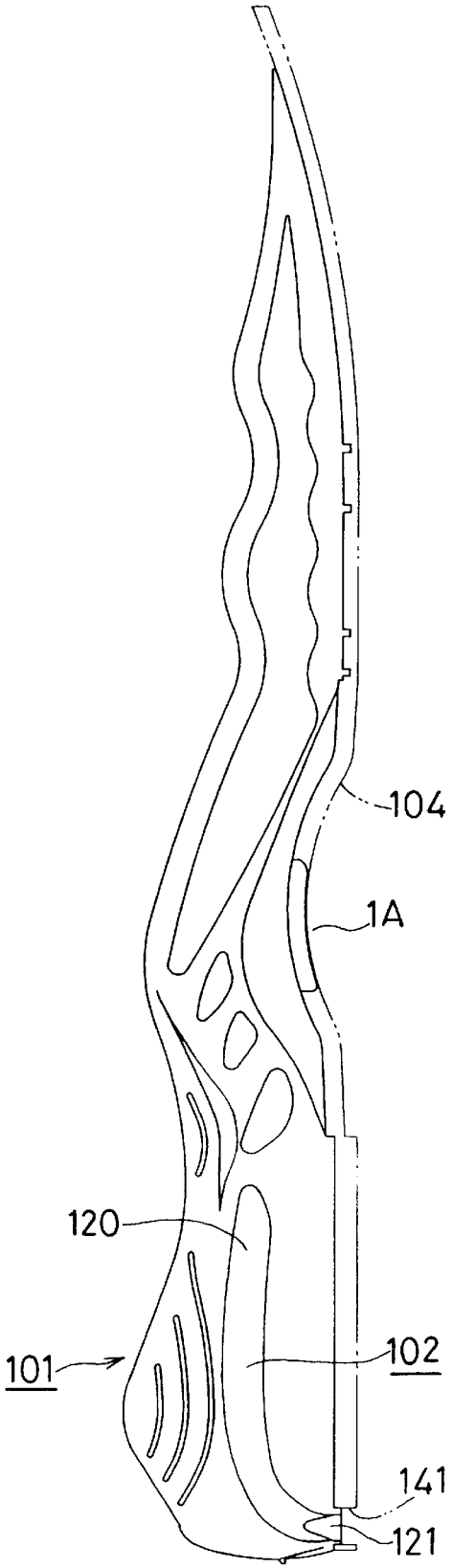
FIG. 12 is a side view of a midsole taken from the medial side of the foot.
Figure 13:
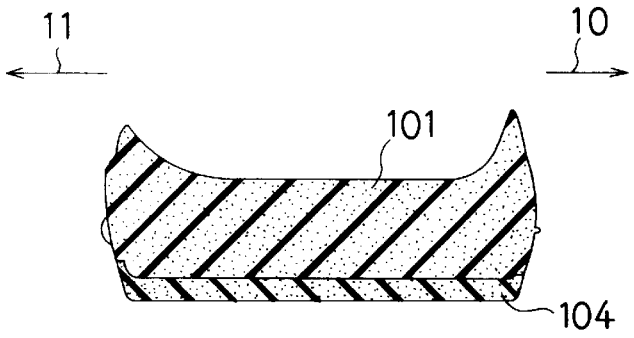
FIG. 13 is a sectional view taken along the line XIII—XIII in FIG. 9.
Figure 14:
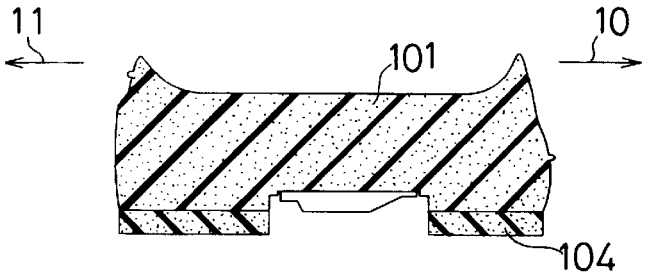
FIG. 14 is a sectional view taken along the line XIV—XIV in FIG. 9.
Figure 15:
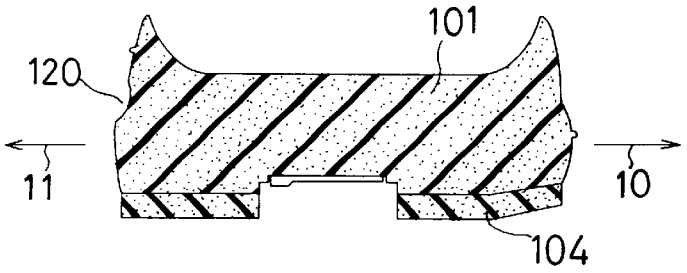
FIG. 15 is a sectional view taken along the line XV—XV in FIG. 9.
Figure 16:
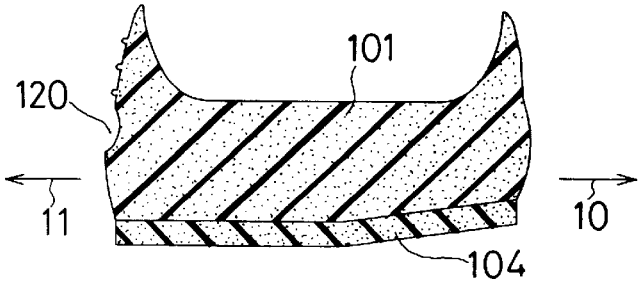
FIG. 16 is a sectional view taken along the line XVI—XVI in FIG. 9.
Figure 17:
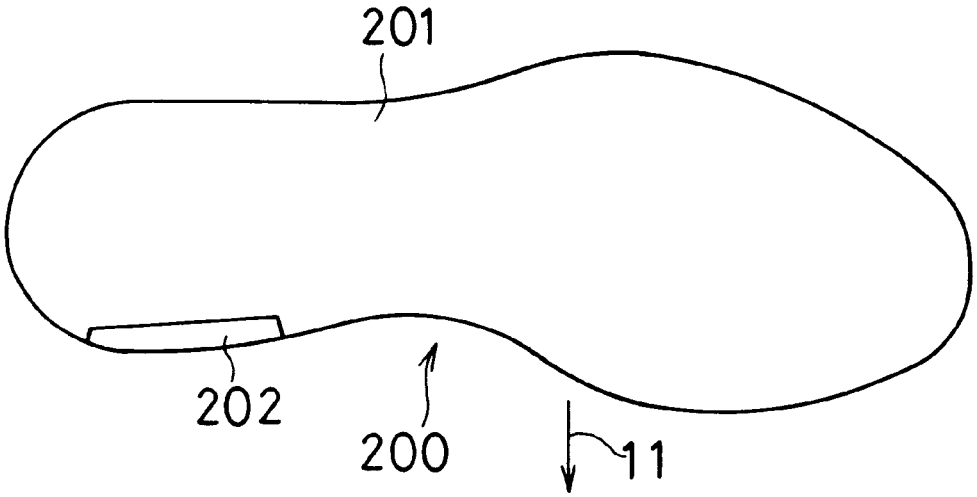
FIG.17 PRIOR ART
FIG. 17 is a plan view of a midsole disclosed in the Japanese Patent Publication (examined) No. 61-7801.
Figure 18:
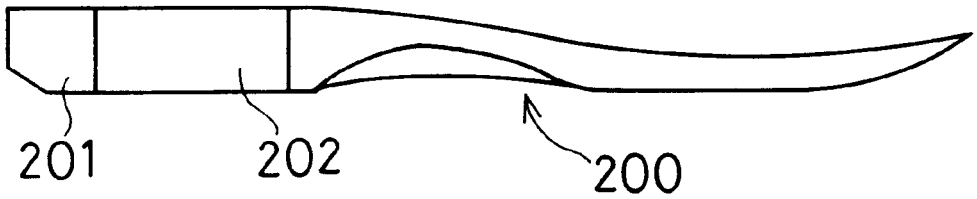
FIG.18 PRIOR ART
FIG. 18 is a side view of the midsole disclosed in the same patent publication.
Figure 19:
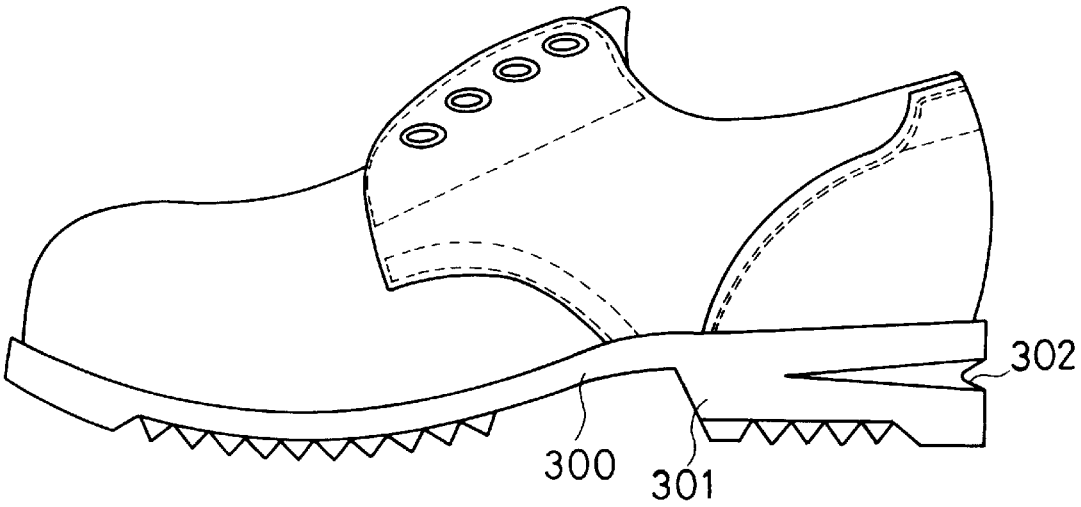
FIG.19 PRIOR ART
FIG. 19 is a side view of a shoe disclosed in the Japanese Laid-Open Patent Publication (unexamined) No. 3-51005.
Figure 20:
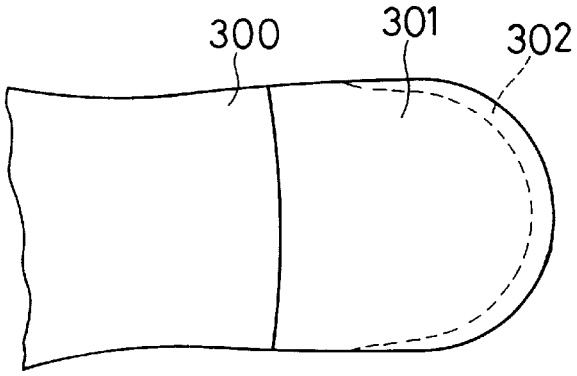
FIG.20 PRIOR ART
FIG. 20 is a bottom view of a sole disclosed in the same patent publication.

As shown in FIGS. 10 and 11, a midsole 101 is interposed between an upper 103 and an outer sole 104, and forms a part of the athletic shoe. The upper 103 accommodates an instep of a foot. On the other hand, the outer sole 104 has a tread 140 on its outer surface.

Basic function and material of the midsole 101 and the outer sole 104 are same as those of the first embodiment, and description thereof is omitted herein.

Figure 9:
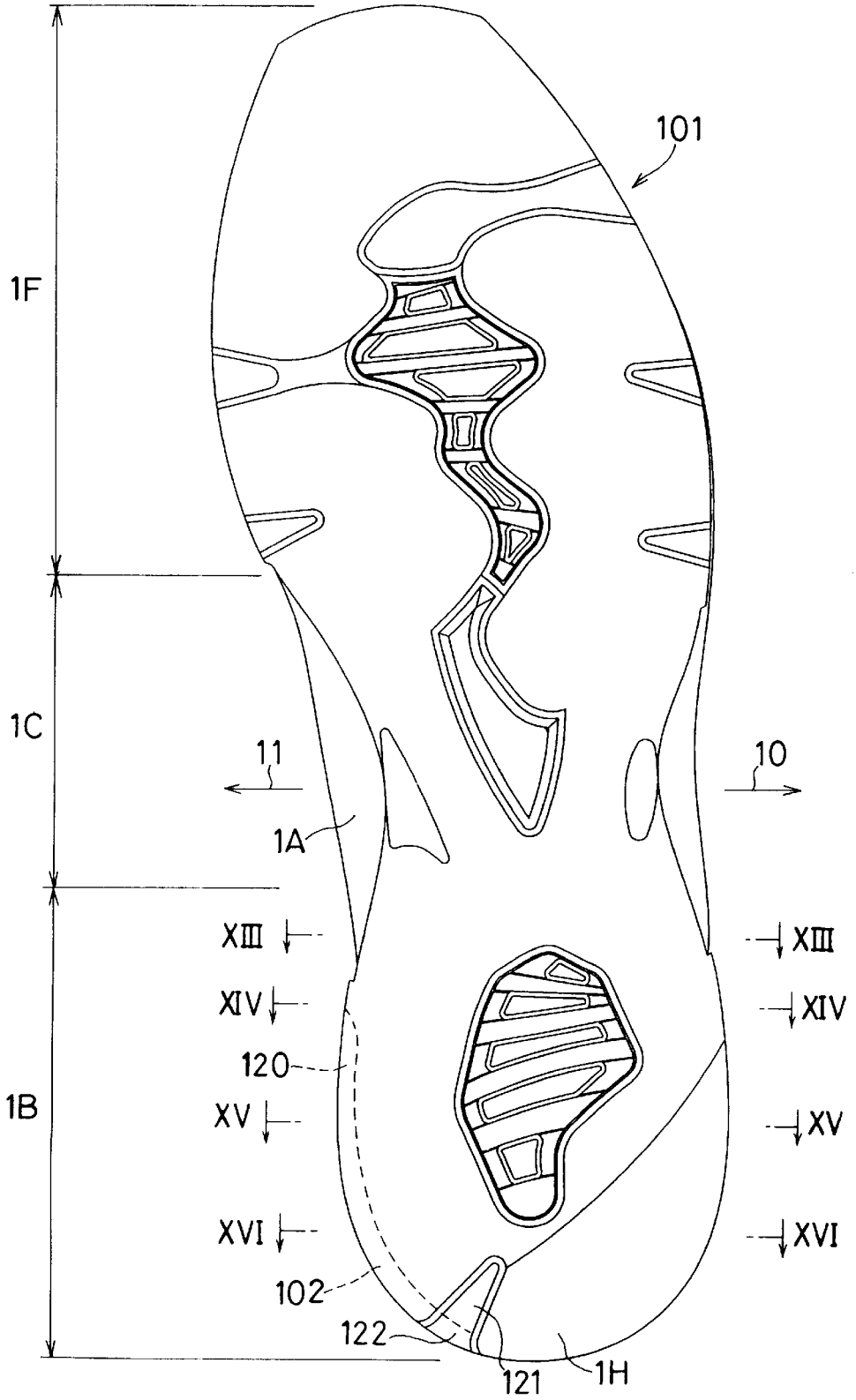
FIG. 9 is a bottom view of amidsole according to a second embodiment of the present invention.

Referring to FIG. 9, in the midsole 101, a shock absorbing groove 102 is formed as shown by broken line. The shock absorbing groove 102 comprises a long transverse groove 120 shown in FIGS. 10 and 12, and a short longitudinal groove 121 shown in FIGS. 10 and 9.

The transverse groove 120 is formed on the midsole 101 extending from a side face of the rear foot part 1B of the midsole 101 on a medial side 11 of a foot to a back face of a heel part 1H of the midsole 101, and has an end 122 on the back face of the heel part 1H. That is, the transverse groove 120 is not formed on a lateral side 10 of the foot in the midsole 101.

As shown in FIG. 10, the longitudinal groove 121 is formed in such a manner as to cut out the heel part 1H of the midsole 101 from a lower end face 114 of the midsole 101 toward the end 122 of the transverse groove 120. As shown in FIG. 9, the longitudinal groove 121 is formed in such a manner as to cut out the midsole 101 a little long toward the fore part of the foot. In addition, a cutout portion 141 is also formed on the outer sole 104 shown in FIG. 10 at a location corresponding to the longitudinal groove 121 formed on the midsole 101.

When running putting on the athletic shoe according to this embodiment, the portion of the medial side 11 of the midsole 101 is deformed in such a manner as to be compressed vertically at the transverse groove 120, and the supination of inclining the foot toward the lateral side 10 can be restrained.

Having described the preferred embodiments with reference to the drawings, it will be obvious for those skilled in the art to make various changes and modifications without departing from the spirit and scope of the invention.

For example, it is preferable that a foam material of rubber or resin of smaller hardness than that forming the midsole body is embedded in the shock absorbing groove 2 or the shock absorbing groove 102. Further, the location of the shock absorbing groove 2 or 102 may be displaced vertically and horizontally without departing from the spirit and scope of the invention.

Consequently, it should be understood that such changes and modifications fall within the scope of the invention determined by the appended claims.

What is claimed is:

1. An athletic shoe comprising an upper for accommodating an instep of a foot, and outer sole having a tread on bottom surface, and a midsole interposed between the upper and the outer sole, wherein a shock absorbing groove is formed in the midsole, the shock absorbing groove is formed of a long transverse groove and a short longitudinal groove in a continuous manner, the transverse groove is formed on the midsole extending from a side face of a rear foot part of the midsole on a lateral side of the foot to a back face of a heel part of the midsole, and has an end on the back face of the heel part, wherein the transverse groove is not substantially formed on a side face of the rear foot part of the midsole on a medial side of the foot, and the longitudinal groove is formed in such a manner as to cut out the heel part of the midsole from a lower end face of the midsole toward the end of the transverse groove and as to rise toward the end of the transverse groove.

2. The athletic shoe according to claim 1, wherein the outer sole is cut out at a location corresponding to the longitudinal groove formed on the midsole.

3. The athletic shoe according to claim 1, wherein the longitudinal groove of the midsole is formed in such a manner as to cut out the midsole toward a fore part of foot.

4. The athletic shoe according to claim 1, wherein the midsole is formed of a foam material extending from a forefoot part to the rear foot part, and hardness of a medial side of the rear foot part and the medial side of an arch part of the midsole is set to a value larger than that of the lateral side of the rear foot part and the forefoot part of the midsole.

5. An athletic shoe comprising an upper for accommodating an instep of a foot, and outer sole having a tread on bottom surface, and a midsole interposed between the upper and the outer sole, wherein a shock absorbing groove is formed in the midsole, the shock absorbing groove is formed of a long transverse groove and a short longitudinal groove in a continuous manner, the transverse groove is formed on the midsole extending from a side face of a rear foot part of the midsole on lateral side of the foot to a back face of a heel part of the midsole, and has an end on the heel part, and the longitudinal groove is formed in such a manner as to cut out the heel part of the midsole from a lower end face of the midsole toward the end of the transverse groove wherein the midsole is formed of a foam material extending from a forefoot part to the rear foot part, and hardness of a medial side of the rear foot part and the medial side of an arch part of the midsole is set to a value larger than that of the lateral side of the rear foot part and the forefoot part of the midsole.

* * * * *